US008267617B2

(12) United States Patent
Bradford et al.

(10) Patent No.: US 8,267,617 B2
(45) Date of Patent: Sep. 18, 2012

(54) EXPANSION JOINT SYSTEM

(75) Inventors: Paul Bradford, West Falls, NY (US); James Derrigan, Tonawanda, NY (US)

(73) Assignee: Construction Research & Technology GmbH, Trostberg (DE)

( * ) Notice: Subject to any disclaimer, the term of this patent is extended or adjusted under 35 U.S.C. 154(b) by 119 days.

(21) Appl. No.: 12/747,381

(22) PCT Filed: Dec. 14, 2007

(86) PCT No.: PCT/US2007/025625

§ 371 (c)(1), (2), (4) Date: Jun. 10, 2010

(87) PCT Pub. No.: WO2009/078829

PCT Pub. Date: Jun. 25, 2009

(65) Prior Publication Data

US 2010/0263312 A1 Oct. 21, 2010

(51) Int. Cl.
*E01C 11/24* (2006.01)
*E01C 11/06* (2006.01)

(52) U.S. Cl. ..... 404/47; 404/49; 404/51

(58) Field of Classification Search ..... 404/47, 404/49, 51

See application file for complete search history.

(56) References Cited

U.S. PATENT DOCUMENTS 3,270,474 A * 9/1966 Driggers ..... 52/395
3,435,574 A 4/1969 Hallock
3,448,552 A 6/1969 Schmitt et al.
3,696,575 A * 10/1972 Armstrong ..... 52/288.1
4,319,855 A 3/1982 Huber et al.
4,706,318 A 11/1987 Huber et al.
5,078,529 A * 1/1992 Moulton ..... 403/24
5,543,987 A 8/1996 Matsumoto
5,799,456 A 9/1998 Shreiner et al.
6,014,848 A * 1/2000 Hilburn, Jr. ..... 52/396.04
6,115,980 A 9/2000 Knak et al.
6,449,790 B1 9/2002 Szekely
6,499,265 B2 12/2002 Shreiner
7,143,560 B2 * 12/2006 Jesko ..... 52/395
2008/0127590 A1 * 6/2008 Derrigan et al. ..... 52/395

OTHER PUBLICATIONS

International Search Report for corresponding PCT Application No. PCT/US2007/025625, mailed Aug. 21, 2008.

International Written Opinion for corresponding PCT Application No. PCT/US2007/025625, mailed Aug. 21, 2008.

* cited by examiner

*Primary Examiner* — Raymond W Addie

(74) *Attorney, Agent, or Firm* — Curatolo Sidoti Co., LPA; Salvatore A. Sidoti; Julie D. Hawk

(57) ABSTRACT

A cover plate system for a gap (15) between two structural members (10, 20) is provided. The system includes an elongated cover (30) that extends across the gap (15) from a first structural member (10) to a second, spaced-apart structural member (20). The cover plate system further includes damped spring anchors (40) for engaging the cover plate (30) to an underlying structural member (10) and dampers (50, 60) for absorbing energy imparted to the cover plate (30) by vehicular traffic. The cover plate system minimizes the strain energy that is absorbed by the cover plate (30), which results in less cover plate slapping and bouncing during operation.

20 Claims, 3 Drawing Sheets

EXPANSION JOINT SYSTEM

CROSS REFERENCE TO RELATED APPLICATIONS

This application is a national stage application under 35 U.S.C. §371 of International Application No. PCT/US2007/025625, filed on 14 Dec. 2007, from which application priority is claimed, and which is incorporated herein by reference in its entirety.

TECHNICAL FIELD

An expansion joint system for bridging a gap between spaced-apart adjacent structural members is provided. The expansion joint system includes spring anchors and load absorption means in combination with a load bearing cover plate that extends across the gap between the two structural members. The expansion joint system may be used in roadway constructions, bridge constructions, and other constructions where it is desirable to accommodate movements of the structural members adjacent to the expansion joint gap relative to one another.

BACKGROUND

Dimensional changes occur between structural members in response to expansion and contraction due to, for example, temperature changes, shortening and creep caused by prestressing concrete members, seismic cycling, vibrations, deflections caused by live loads, and longitudinal forces caused by vehicular traffic. An expansion joint gap is purposefully provided between the adjacent structural members for accommodating these dimension changes. These dimensional changes result in the expansion and contraction of the width of the expansion joint gap between the spaced apart structural members. Expansion joint systems are positioned within the expansion joint gap may to accommodate the movements in the vicinity of the gap, but still permit flow of traffic across the gap.

Cover plate expansion joints are one type of expansion joint system for bridging a gap between spaced-apart adjacent structural members. A cover plate expansion joint system includes a structural load bearing plate that extends across the expansion joint gap to cover the gap and anchors for engaging the cover plate to the underlying structural members. Generally, the cover plate extends from a first structural member to a second structural member. The cover plate overlies portions of the structural member on either side of the gap in order to support the cover plate. Vehicular traffic rides across the cover plate, passing from one roadway section to another spaced-part roadway section.

The cover plate is free to move in at least one dimension with respect to at least one of the structural members. The cover plate is separated from at least one supporting structural member with which it is free to move by some sort of sliding interface. Vertical motion between the structural members can rotate and stress the cover plate. These load stresses are large enough to damage the cover plate, pull out anchors, cause fatigue damage near anchor holes, or otherwise damage the expansion joint system.

When traffic travels over the cover plate, it downwardly loads the plate and causes the plate and structure to deflect downwardly. In conventional cover plate systems, there is either no or very little plate rotational capacity. The result is that traffic traveling over the plate loads the plate causing the plate and structure to deflect. This creates "plate slap" as the plate impacts the supporting structural member. As the traffic moves away from the cover plate, the cover plate is unloaded thereby allowing the strain imparted to the cover plate and structure to be released. The release of the strain on the cover plate sometimes creates "plate bounce" as the deflected plate springs back into position. Both plate slap and plate bounce are generally undesirable, not only because they create unnecessary noise and vibration, but because they are symptomatic of operation which can harm the expansion joint system.

While cover plate expansion joint systems have achieved acceptance by structural engineers, they suffer from the above mentioned performance shortcomings. Accordingly, it remains desirable to provide a cover plate expansion joint system which can accommodate traffic without the resultant plate slapping or plate bouncing, and also minimizes fatigue failure near anchor holes, lack of impact absorption, inability to accommodate vertical offset between adjacent structural members, pull-out of anchors, and spalling and cracking of concrete in header regions of the system.

SUMMARY

Provided is a cover plate expansion joint system for bridging a gap between spaced apart structural members, the system comprising an elongated plate extending across said gap between said structural members, at least one load absorbing damper positioned between said elongated plate and at least one of said structural members; at least one anchor for anchoring said elongated plate to one of said structural members; and at least one spring engaged with said at least one anchor.

According to certain embodiments, the cover plate expansion joint system for bridging a gap between spaced apart structural members comprises an elongated plate extending across said gap between said structural members, at least one load absorbing damper positioned between said elongated plate and at least one of said structural members; at least one anchor for anchoring said elongated plate to one of said structural members; and at least one spring engaged with said at least one anchor, wherein said least one spring applies a torque on said elongated plate.

According to further embodiments, the cover plate expansion joint system for bridging a gap between spaced apart structural members comprises an elongated plate extending across said gap between said structural members, load absorbing dampers positioned between said elongated plate and at least one of said structural members adapted to resist a compressive load between said elongated cover and said structural members; at least one anchor for anchoring said elongated plate to one of said structural members; and at least one spring engaged with said at least one anchor, wherein said at least one spring produces a compressive load between the elongated cover and said structural members.

DETAILED DESCRIPTION

Figure 1:
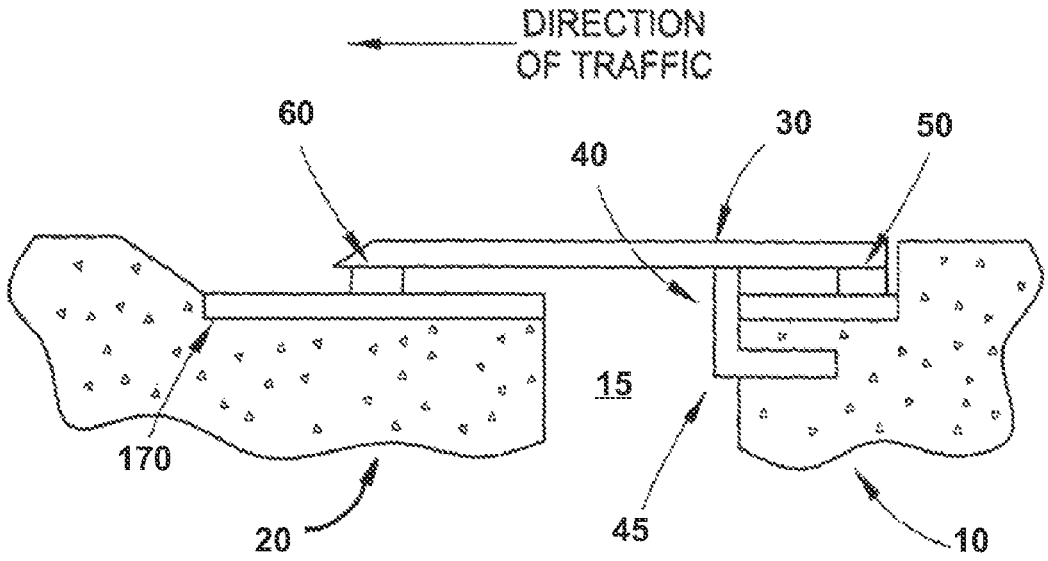
FIG. 1 illustrates a side elevational view of one illustrative embodiment of the expansion joint system.

Disclosed is a plate-type expansion joint system that is installed in a gap between spaced apart adjacent structural members. The expansion joint system may be utilized in roadway, bridge, and tunnel constructions to accommodate movements of the structural members adjacent to the expansion joint gap relative to one another and to provide a smooth transition across the spaced apart structural members. The expansion joint system generally includes an elongated cover plate for bridging the gap, anchors for anchoring the cover plate to the underlying structural members, spring engaged or otherwise interfaced with the anchors, and load absorbing dampers.

The spaced apart structural members are the components for which motion with respect to one another is to be accommodated by the cover plate expansion joint system. Typical structural members are parts of a bridge, roadway, or tunnel which support vehicular or pedestrian traffic. Structural members which bear traffic comprise a traffic bearing surface.

The expansion joint system for bridging a gap between a first structural member and a second structural member may comprise an elongated cover extending across the gap between two spaced apart structural members, an anchoring damped spring adapted to produce a compressive load between the elongated cover and the first structural member and adapted to produce a compressive load between the elongated cover and the second structural member, at least one proximal damped spring between the elongated cover and the first structural member and adapted to resist a compressive load between said elongated cover and the first structural member, and at least one distal damped spring between the elongated cover and the second structural member adapted to resist a compressive load between said elongated cover and said second structural member.

The cover plate may be any member sufficient to support the design loads from traffic crossing the expansion gap while being supported by the disclosed load absorbing dampers. The cover plate may comprise metal, metal alloys, polymers, composite materials, or combinations thereof. The cover plate may comprise metal or metal alloys selected from the group consisting of steel, aluminum, brass, bronze, titanium alloys, magnesium alloys, or combinations thereof. According to certain illustrative embodiments, the cover plate may also include a slip-resistant coating on the traffic bearing surface of the plate.

The cover plate system includes load absorbing dampers, such as damped springs. A spring is any component which produces a restorative force in response to deflection. Springs comprise compression coil springs, tension coil springs, leaf springs, gas springs, elastic bands, and elastomeric pads. A damper is any component which converts mechanical energy to some other form of energy. Dampers comprise viscous dampers, such as gas shock absorbers, components having substantial hysteresis, and friction dampers. One kind of damped spring would be an elastomeric pad having substantial hysteresis. Without limitation and for illustration only, one embodiment of an elastomeric pad having substantial hysteresis is a polyurethane pad. Without limitation and for illustration only, another embodiment of a damped spring is a compression spring mounted in a mechanically parallel fashion with a viscoelastic damper such as a gas shock absorber. Damped springs will have two ends, each end being moveable with respect to the other as the spring deflects. A damped spring may be engaged with two separate components, one at each end of the damped spring, in order to create a force on the components as a move relative to one another.

Seals may be provided between the structural members and/or other components of the expansion joint to occlude transmission of water and debris. Seals may be flexible and compressible and, therefore can stretch and contract in response to movement structural members and other components of the expansion joint. The seals may be made from a durable and abrasion resistant elastomeric material. The seals are not limited to any particular type of seal. Suitable seals that may be used include, but are not limited to, strip seals, glandular seals, and membrane seals.

The expansion joint system will now be described in greater detail in conjunction with illustrative FIGS. 1-6. The expansion joint system is not intended to be limited to the illustrative embodiments shown in FIGS. 1-6.

FIG. 1 shows an illustrative embodiment of the expansion joint system. The side of the gap from which traffic flows is referred to as the upstream side. The side of the gap to which traffic flows is referred to as the downstream side. As shown in FIG. 1, the expansion joint system comprises a first structural member 10 on the upstream side of the gap 15 and a second structural member 20 on the downstream side of the gap 15. A cover plate 30 extends across the gap 15 between first 10 and second 20 structural members. Opposite margins of cover plate 30 overlie portions of first 10 and second 20 structural members. A damped spring 40 engaged or otherwise interfaced with anchorage 45, a damped spring 50 positioned upstream of damped spring 40, and a damped spring 60 positioned downstream of damped spring 40 are shown. The expansion joint system shown in FIG. 1 further comprises optional resilient base elements 170 affixed to the structural members 10 and 20. As shown, the damped spring 40 and associated anchor 45 are engaged with the first structural member 10. The damped anchor 40 may optionally be engaged with the first structural member 10 by means of further anchor members.

Without limitation, an anchor member 45 may provide an interface between a structural member 10 and damped spring 40. In certain embodiments, the anchor 45 comprises an enclosure which is engaged with the damped spring 40 by capturing, housing or substantially enclosing the damped spring 40. In other embodiments, the anchor comprises an element which interfaces with the damped spring 40 by other suitable engagement means. Suitable engagement means may comprise fasteners, adhesives, welding, over-casting, springs and combinations thereof. Without limitation, fasteners comprise bolts, screws, pins, hooks, and rivets. Similarly, the anchor member 45 may be engaged with the structural member 10 by the above-noted suitable engagement means. In certain embodiments, the optional anchor member 70 is cast into the structural member 10.

In other embodiments, the damped spring 40 is engaged with the structural member 10 directly by the above-noted suitable engagement means. The alternative embodiments for engagement of the damped spring 40 with the structural member 10 each have their own advantages and may be elected amongst as appropriate by one of ordinary skill in the art. Advantages of direct engagement include simplicity, while the inclusion of an anchor member 45 may permit higher engagement forces. Whatever means are used to engage the damped spring 40 and the structural member 10, at least one end of damper spring 40 is not free to move with respect to structural member 10.

The damped spring 40 is also engaged or otherwise interfaced with the cover plate 30. Suitable engagement means for engagement between the damped spring 40 and the cover plate 30 comprise use of fasteners, adhesives, welding, overcasting, springs and combinations thereof. Without limitation, fasteners comprise bolts, screws, pins, hooks, and rivets. In certain embodiments first damped spring 40 comprises a polyurethane cylinder that is engaged to the cover plate 30 with an elongated bolt.

The damped spring 40 is pre-loaded such that the forces from the damped spring 40 on the cover plate 30 and the forces from the damped spring 40 on the structural member 10 promote proximity between the cover plate 30 and the structural member 10. The damped spring 40 produces or exerts forces which resist separation of the cover plate 30 and the structural member 10. It is not necessary that the cover plate 30 and the structural member 10 are actually forced into direct contact with one another, as there may be intervening elements between the cover plate 30 and the structural member 10. Nevertheless, the damped spring 40 should create a force sufficient for urging the cover plate 30 and the structural member 10 toward one another. If the separation between cover plate 30 and the structural member 10 increases, the spring force from damped spring 40 increases to restore proximity.

The cover plate 30 is also engaged or interfaced with the structural member 10 by damped spring 50. Damped spring 50 is pre-loaded to produce forces tending to separate cover plate 30 and the structural member 10. It is not necessary that the cover plate 30 and the structural member 10 be moved apart by the force from damped spring 50, but that is the tendency of the force from damped spring 50. Effective means for engagement between the damped spring 50 and the cover plate 30 comprise the same means as noted above for engagement between the damped spring 40 and the cover plate 30. In certain embodiments, damped spring 50 is a polyurethane pad. In certain embodiments, damped spring 50 is a polyurethane pad which is cast into cover plate 30. Effective means for engagement between the damped spring 50 and the structural member 10 comprise those same means as noted above for engagement between the damped spring 40 and the cover plate 30. In certain embodiments, damped spring 50 is a polyurethane pad which is pressed into contact with the structural member 10 in part by the pre-load in damped spring 40.

The cover plate 30 is engaged or interfaced with the structural member 20 by damped spring 60. Damped spring 60 is pre-loaded to produce forces tending to separate cover plate 30 and the structural member 20. It is not necessary that the cover plate 30 and the structural member 20 be moved apart by the force from damped spring 60, but that is the tendency of the force from damped spring 60. Because the cover plate 30 must be free to slide horizontally with respect to structural member 20, either the cover plate must be free to slide horizontally with respect to damped spring 60, or damped spring 60 must be free to slide horizontally with respect to structural member 20. Effective means for engagement between the damped spring 60 and the cover plate 30 comprise those same means as noted above for engagement between the damped spring 40 and the cover plate 30. Effective means for engagement between the damped spring 60 and the structural member 20 comprise those means noted above for engagement between the damped spring 40 and the cover plate 30. In certain embodiments, damped spring 60 is a polyurethane pad. In certain embodiments, damped spring 60 is a polyurethane pad which is cast into cover plate 30. In certain embodiments, damped spring 60 is a polyurethane pad which is pressed into contact with the structural member 20 in part by the pre-load in damped spring 40.

Figure 2:
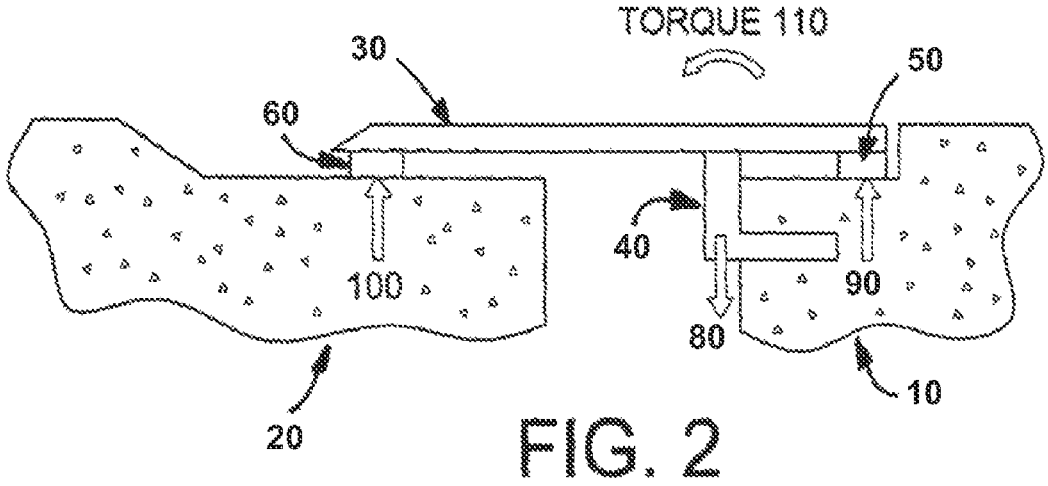
FIG. 2 illustrates a side elevational view of one illustrative embodiment of the expansion joint system with force vectors shown.

FIG. 2 shows the direction of force vectors as a load is applied to the cover plate 30 of the expansion joint system. While the direction of the force vectors 80, 90, 100 are shown, FIG. 2 does not necessarily illustrate the magnitude of the forces acting upon the cover plate 30 from the damped springs 40, 50, and 60. Curved arrow 110 represents the torque applied to the cover plate 30 as a result of the action of the forces from the damped springs 40, 50, 60.

Figure 3:
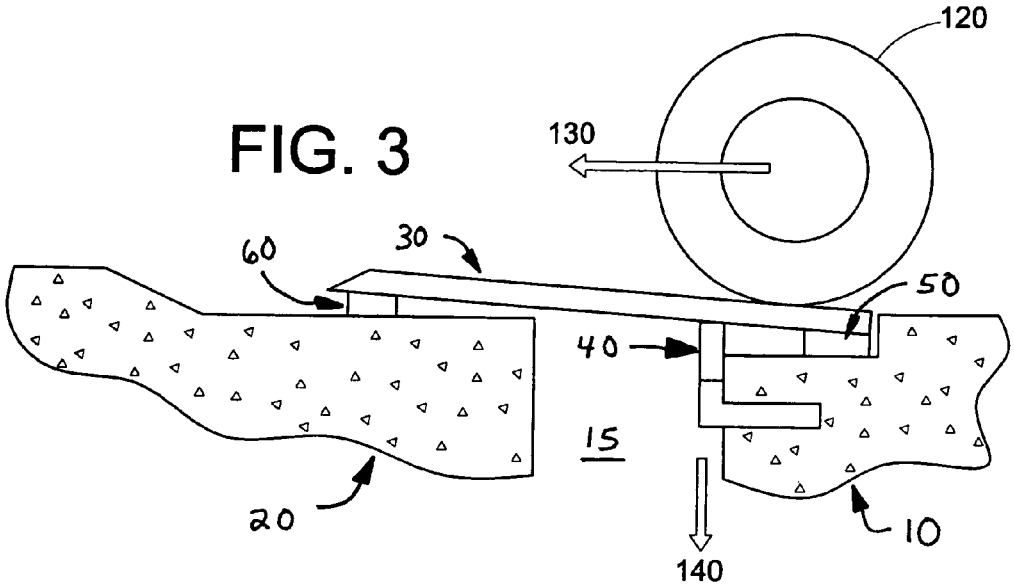
FIG. 3 illustrates a side elevational view of one illustrative embodiment of the expansion joint system undergoing loading on one edge from a vehicle tire.
Figure 4:
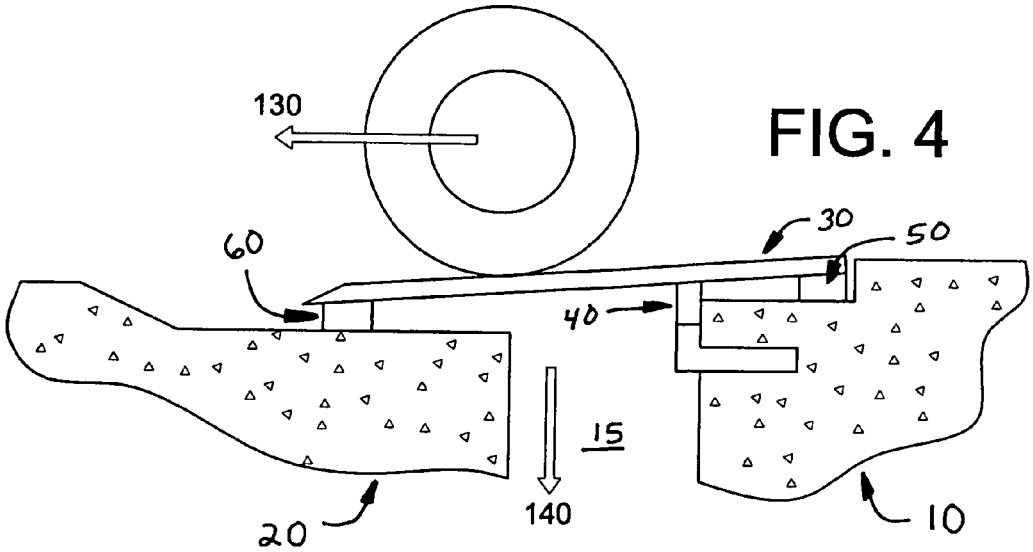
FIG. 4 illustrates a side elevational view of one illustrative embodiment of the expansion joint system undergoing loading on one edge from a vehicle tire.

FIGS. 3 and 4 show the expansion gap 15 and expansion joint system shown in FIG. 1 with the addition of a external load 140. By way of illustration, the source of the external load is a tire 120 of a vehicle (not shown) that has moved onto the cover plate 30 from the upstream traffic side in FIG. 3 and has moved downstream to the position shown in FIG. 4. The direction of motion of is shown by arrow 130. The external load 140 is from the weight of the moving tire 120. As shown, external load 140 causes deflection of the cover plate 30 and the damped springs, 40, 50 and 60 in the direction of the load. Because the damped springs 40, 50, 60 produce a restorative forces in response to the deflection, the deflection of cover plate 30 is less than it would have been absent the damped springs 40, 50 and 60. This deflection may still be much larger than that of conventional expansion joints and still avoid harm to the system because the damped springs absorb some of the potentially destructive energy imparted to the cover plate 30 (as kinetic energy) and dissipate some of it such that the plate carries less potentially destructive energy. Further, because the damped springs 40, 50 and 60 are associated with a damper, the velocity of the cover plate 30 is less than it would have been absent the damped springs 40, 50 and 60. This is another way that the damper protects the expansion joint system by lowering the energy carried by components therein.

As shown in FIG. 4, the transit of the external load from the upstream side to the downstream side causes the upstream side of the cover plate 30 to cycle from high deflection to low-deflection state. A similar transition takes place on the downstream side of the cover plate 30 as the external load transits off of the cover plate 30. Because the damped springs 40, 50 and 60 are associated with a damper, the velocity of the cover plate 30 is less during these transitions of deflection state than it would have been absent the damped springs 40, 50 and 60. The reduction in the magnitude of the deflection and the velocity of the cover plate 30 as it moves cycles between deflection states reduces plate slap, plate bounce, fatigue inducing strain, fatigue inducing stress, spalling and cracking of the header, and pull-out of ground anchors as the external loading traffic moves onto the cover plate 30.

Figure 5:
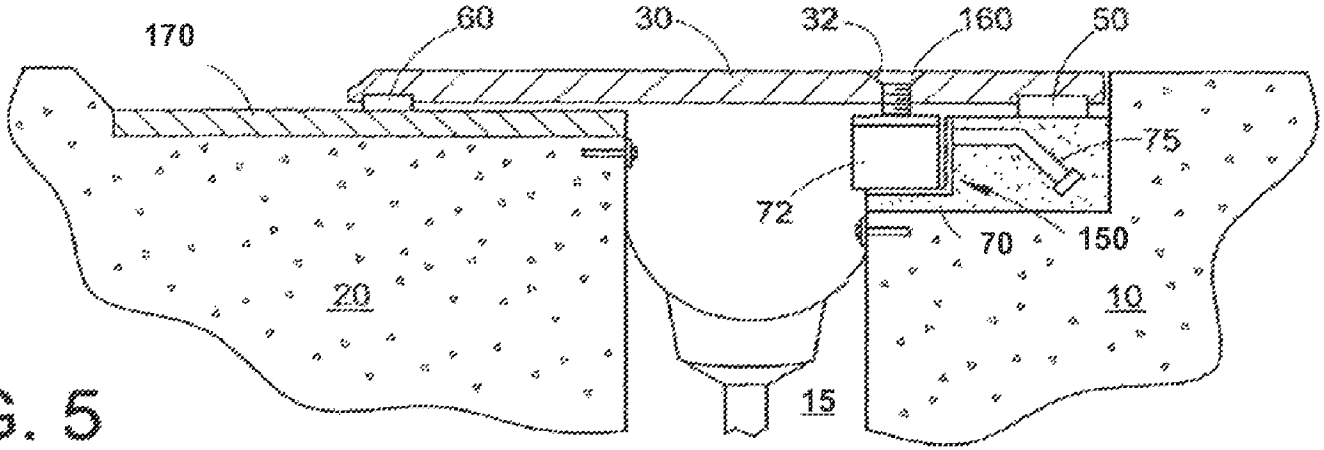
FIG. 5 illustrates a side elevational view of another illustrative embodiment of the expansion joint system.

FIG. 5 shows another embodiment of the expansion joint system. Shown is an upstream structural member 10 and a downstream structural member 20 separated by an expansion gap 15. Attached to the upstream structural member 10 is anchor member 150. In this non-limiting example, the anchor member 150 is a studded steel angle with attached anchor boxes 72. The anchor member 150 is attached to the upstream structural member 10 by ground anchors 75. The ground anchors 75 are cast into an optional header material 70 which is in turn engaged with the structural member 10. In certain embodiments, the optional header material is Wabocrete II, an elastomeric concrete commercially available from Watson Bowman Acme Corp. (Amherst, N.Y.). Alternatively, the ground anchors 75 may be sunk into or cast directly into structural member 10. The engagement between the ground anchors 75 and the anchor member 150 may be by any effective means. Effective means comprise use of fasteners, adhesives, welding, over-casting, springs and combinations thereof. In the non-limiting example shown, the ground anchors 75 are welded to the anchor members 70. The anchor boxes 72 are engaged with the anchor member 150. The engagement between the anchor boxes 72 and the anchor member 150 may be by any of the effective means noted above. In the non-limiting embodiment shown, the anchor boxes 72 are welded to the anchor members 150. The damped spring 40 is captured by anchor box 72 and is not visible in FIG. 5. Bolt 160 engages damped spring 40 to cover plate 30. As shown in FIG. 5, cover plate 30 comprises an optional hole 32 to accommodate the head of bolt 160. Hole 32 may be a counterbore, a countersink, or any other type of hole. Hole 32 may optionally be filled with epoxy or other filler material.

FIG. 5 shows that cover plate 30 is directly adjacent to structural member 10, or through an optional header material 70 by damped spring 50. In this non-limiting example, the damped spring 50 is a polyurethane pad cast into cover plate 30. Damped spring 50 engages structural member 10 directly or through an optional header material 70 due to spring force pre-load from damped spring 40 forcing damped spring 50 into contact with structural member 10 or optional header material 70.

FIG. 5 shows that cover plate 30 is interfaced with structural member 20 directly or through an optional header material 70 by damped spring 60. In this non-limiting example, the damped spring 60 is a polyurethane pad cast into cover plate 30. Damped spring 60 interfaces with structural member 20 directly or through an optional header material 70 due to spring force pre-load from damped spring 40 forcing damped spring 60 into contact with structural member 20 or optional header material 70.

Figure 6:
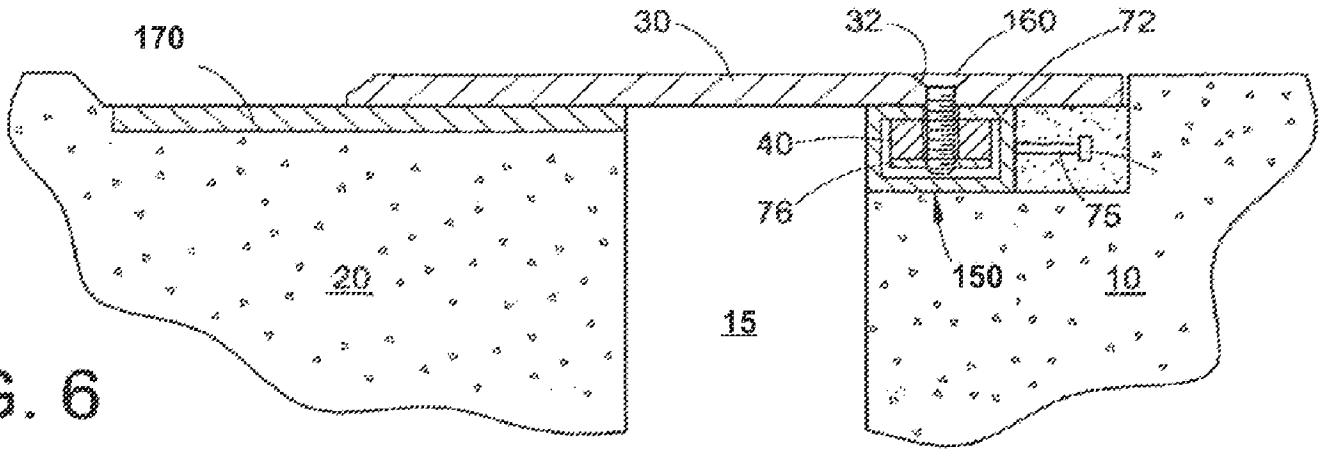
FIG. 6 illustrates a side elevational view of another illustrative embodiment of the expansion joint system.

FIG. 6 shows a sectional view of an embodiment of an expansion joint system with detail of an anchor member 150. In the non-limiting embodiment shown, anchor member 150 includes an anchor box 72. Anchor box 72 captures a damper spring 40 and engages the first end of damper spring 40. On the opposite end of damper spring 40, is a component 76 to engage the second end of damper spring 40 with the bolt 160. Component 76 may be any component suitable to engage damper spring 40 with the bolt 160. In certain embodiments, bolt 160 is male-threaded and component 76 is a female-threaded washer nut.

In certain embodiments, the cover plate 30 is permitted to slide horizontally with respect to one of the two structural members. In certain embodiments, the cover plate 30 is permitted to slide horizontally with respect to the downstream structural member. In certain embodiments, the cover plate 30 is permitted to slide horizontally with respect to the downstream structural member only.

In certain embodiments, the damped spring 40 which engages the cover plate, directly or indirectly to the structural member 10, is between damped spring 50 and damped spring 60.

In certain embodiments, the means of engagement between the damped springs 40, 50, and 60 and the cover plate 30 may be similar to the means of engagement between the damped springs 40, 50, and 60 and the structural members 10 and 20, but this similarity is optional.

The damped springs 40 that are engage or otherwise interfaced with the anchor members provide lateral strength and clamping torque, thereby permitting for cover plate rotation while still supporting heavy loading, such as loading from semi-trucks. The damped springs 40, which according to certain embodiments comprise cylindrical springs, are of a high stiffness polyurethane material that is capable of providing several thousand pounds of clamping torque.

Cover plate rebounding is minimized through the combination of the damped springs that are interfaced with the edge anchors, the load absorbing dampers, and a cover plate manufactured from a high stiffness material and having short widths. Unlike other expansion joint systems, the cover plate expansion joint systems is designed to minimize strain energy absorbed by the cover plate (30). The less strain energy that is stored in the cover plate (30), the less likely the plate is to rebound in response to vehicular loads. Strain energy is reduced by the use of the stiff cover plate, redirected to the load absorbing dampers, such as polyurethane pads, and discretized through the use of short width section of cover plate.

While the expansion joint system has been described above in connection with the certain embodiments, it is to be understood that other embodiments may be used or modifications and additions may be made to the described embodiments for performing the same function of the expansion joint system without deviating therefrom. Further, all embodiments disclosed are not necessarily in the alternative, as various embodiments may be combined to provide the desired characteristics. Variations can be made by one having ordinary skill in the art without departing from the spirit and scope of the expansion joint system. Therefore, the expansion joint system should not be limited to any single embodiment, but rather construed in breadth and scope in accordance with the recitation of the attached claims.

The invention claimed is:

1. A cover plate expansion joint system for bridging a gap between spaced apart first and second structural members comprising:

an elongated plate extending across said gap between said first and second structural members;

at least one pre-loaded load absorbing damper positioned between said elongated plate and said second structural member, wherein said load absorbing damper produces forces tending to separate said elongated plate and said second structural member;

at least one anchor for anchoring said elongated plate to said first structural member; and at least one pre-loaded damped spring engaged with said at least one anchor and said elongated plate, wherein said at least one damped spring anchor produces forces tending to promote proximity between said elongated plate arid said first structural member.

2. The cover plate expansion joint system of claim 1, wherein portions of said elongated plate overlie said first and second spaced apart structural members.

3. The cover plate expansion joint system of claim 1, wherein said elongated plate further comprises a slip resistant coating.

4. The cover plate expansion joint system of claim 1, further comprising a resilient base between said load absorbing dampers and said first and second structural members.

5. The cover plate expansion joint system of claim 4, wherein said resilient base comprises an elastomeric concrete.

6. The cover plate expansion joint system of claim 5, wherein said elastomeric concrete comprises a two component polyurethane and aggregate.

7. The cover plate expansion joint system of claim 5, wherein said elastomeric concrete absorbs impact loads.

8. The cover plate expansion joint system of claim 1, wherein said load absorbing dampers are cast into said elongated plate.

9. The cover plate expansion joint system of claim 8, wherein said load absorbing dampers comprise a polyurethane material.

10. The cover plate expansion joint system of claim 9, wherein said load absorbing dampers are cast into said elongated plate near opposite margins of said first and second structural members.

11. The cover plate expansion joint system of claim 1, wherein said at least one damped spring anchor comprises a polyurethane material.

12. The cover plate expansion joint system of claim 11, wherein said at least one damped polyurethane spring anchor comprises cylindrical springs.

13. The cover plate expansion joint system of claim 1, wherein said at least one damped spring anchor is engaged to said elongated cover by fasteners.

14. The cover plate expansion joint system of claim 13, wherein said fasteners are selected from the group consisting of bolts, screws, rivets, nails, pins, and combinations thereof.

15. The cover plate expansion joint system of claim 10, wherein said fasteners comprise bolts.

16. The cover plate expansion joint system of claim 1, wherein said at least one damped spring anchor is engaged to an anchor structure, and wherein said anchor structure is engaged to one of said structural members.

17. A cover plate expansion joint system for bridging a gap between spaced apart first and second structural members comprising:

an elongated plate extending across said gap between said first and second structural members;

at least one load absorbing damper positioned between said elongated plate and at least one of said structural members;

at least one anchor for anchoring said elongated plate to one of said structural members; and at least one damped spring engaged with said at least one anchor and said elongated plate, wherein said at least one damped spring applies a torque on said elongated plate to urge said elongated plate against said structural members.

18. A cover plate expansion joint system for bridging a gap between spaced apart structural members comprising:

an elongated plate extending across said gap between said structural members;

at least one load absorbing damper positioned between said elongated plate and at least one of said structural members, wherein said load absorbing damper produces forces tending to separate said elongated plate and said second structural member;

at least one anchor for anchoring said elongated plate to one of said structural members; and at least one damped spring engaged with said at least one anchor and said cover plate, wherein said at least one damped spring applies a moment on said elongated plate to urge said elongated plate against said structural members.

19. A cover plate expansion joint system for bridging a gap between spaced apart structural members comprising:

an elongated plate extending across said gap between said structural members;

load absorbing dampers positioned between said elongated plate and at least one of said structural members adapted to resist a compressive load between said elongated cover and said structural members; and at least one anchor for anchoring said elongated plate to one of said structural members; and at least one damped spring engaged between said at least one anchor and said elongated plate, wherein said at least one damped spring provides a compressive load between the elongated cover and said structural members.

20. The cover plate expansion joint system of claim 19, comprising:

at least one load absorbing damper positioned between said elongated plate and said first structural member adapted to resist a compressive load between said elongated cover and said structural member; and at least one load absorbing damper positioned between said elongated plate and said second structural member adapted to resist a compressive load between said elongated cover and said structural member.

* * * * *